US007627480B2

(12) United States Patent
Ojanpera

(10) Patent No.: US 7,627,480 B2
(45) Date of Patent: Dec. 1, 2009

(54) SUPPORT OF A MULTICHANNEL AUDIO EXTENSION

(75) Inventor: Juha Ojanpera, Tampere (FI)

(73) Assignee: Nokia Corporation, Espoo (FI)

( * ) Notice: Subject to any disclaimer, the term of this patent is extended or adjusted under 35 U.S.C. 154(b) by 759 days.

(21) Appl. No.: 10/834,376

(22) Filed: Apr. 28, 2004

(65) Prior Publication Data

US 2004/0267543 A1 Dec. 30, 2004

(30) Foreign Application Priority Data

Apr. 30, 2003 (WO) ..... PCT/IB03/01692

(51) Int. Cl.
*G10L 19/00* (2006.01)
*G10L 21/00* (2006.01)
*H04H 20/47* (2008.01)

(52) U.S. Cl. ..... 704/500; 704/201; 381/2

(58) Field of Classification Search ..... None
See application file for complete search history.

(56) References Cited

U.S. PATENT DOCUMENTS

| | | | | |
|---|---|---|---|---|
| 4,534,054 | A * | 8/1985 | Maisel | 381/4 |
| 5,539,829 | A | 7/1996 | Lokhoff et al. | 381/2 |
| 5,606,618 | A | 2/1997 | Lokhoff et al. | 381/2 |
| 5,671,287 | A * | 9/1997 | Gerzon | 381/17 |
| 6,016,473 | A | 1/2000 | Dolby | 704/500 |
| 6,487,535 | B1 * | 11/2002 | Smyth et al. | 704/500 |
| 7,249,016 | B2 * | 7/2007 | Chen et al. | 704/223 |
| 7,266,501 | B2 * | 9/2007 | Saunders et al. | 704/500 |
| 2005/0053242 | A1 * | 3/2005 | Henn et al. | 381/22 |

FOREIGN PATENT DOCUMENTS

| | | |
|---|---|---|
| EP | 0 574 145 | 5/1993 |
| EP | 0563832 A1 | 10/1993 |
| EP | 0 875 999 | 11/1998 |
| WO | WO03/007656 A1 | 1/2003 |

OTHER PUBLICATIONS

"The Modulated Lapped Transform, its Time-Varying Forms, and its Applications to Audio Coding Standards", S. Shlien, IEEE Transactions on Speech and Audio Processing, vol. 5, No. 4, Jul. 1997, pp. 359-366.

(Continued)

*Primary Examiner*—David R Hudspeth
*Assistant Examiner*—Samuel G Neway

(57) ABSTRACT

Methods and units supporting a multichannel audio extension in a multichannel audio coding system are shown. In order to allow an efficient extension of an available mono audio signal $\tilde{M}$ of a multichannel audio signal L/R, it is proposed that an encoding end of the multichannel audio coding system provides dedicated multichannel extension information for lower frequencies of the multichannel audio signal L/R, in addition to multichannel extension information at least for higher frequencies of the multichannel audio signal L/R. This dedicated multichannel extension information enables a decoding end of the multichannel audio coding system to reconstruct the lower frequencies of the multichannel audio signal L/R with a higher accuracy than the higher frequencies of the multichannel audio signal L/R.

31 Claims, 4 Drawing Sheets

OTHER PUBLICATIONS

"Why Binaural Cue Coding is better than Intensity Stereo Coding", Baumgarte et al., Audio Engineering Society, Convention Paper 5575, May 2002, pp. 1-10.

"Sum-Difference Stereo Transform Coding", Johnston et al., IEEE 1992, pp. II-569-II-572.

"Analysis/Synthesis Filter Bank Design Based on Time Domain Aliasing Cancellation", Princen et al., IEEE Transactions on Acoustics, Speech and Signal Processing, vol. ASSP-34, No. 5, Oct. 1986, pp. 1153-1161.

"Test of ISO/IEC 14496-3:2001/FPDAM 1, Bandwidth Extension", International Organization for Standardization, Organization Internationale De Normalisation, ISO/IEC JTC1/SC29/WG11, Coding of Moving Pictures and Audio, ISO/IEC JTC1/SC29/WG11/N5203, Oct. 2002.

European Office Action (Communication pursuant to Article 96(2) EPC) issued in corresponding EP Application No. 03717483.6-1224, dated Oct. 19, 2007.

* cited by examiner

SUPPORT OF A MULTICHANNEL AUDIO EXTENSION

CROSS-REFERENCE TO RELATED APPLICATION

This application claims priority under 35 U.S.C. §119 from International Application PCT/IB03/01692 filed Apr. 30, 2003.

BACKGROUND OF THE INVENTION

1. Technical Field

The invention relates to multichannel audio coding and to multichannel audio extension in multichannel audio coding. More specifically, the invention relates to a method for supporting a multichannel audio extension at an encoding end of a multichannel audio coding system, to a method for supporting a multichannel audio extension at a decoding end of a multichannel audio coding system, to a multichannel audio encoder and a multichannel extension encoder for a multichannel audio encoder, to a multichannel audio decoder and a multichannel extension decoder for a multichannel audio decoder, and finally, to a multichannel audio coding system.

2. Discussion of Related Art

Audio coding systems are known from the state of the art. They are used in particular for transmitting or storing audio signals.

FIG. 1 shows the basic structure of an audio coding system, which is employed for transmission of audio signals. The audio coding system comprises an encoder 10 at a transmitting side and a decoder 11 at a receiving side. An audio signal that is to be transmitted is provided to the encoder 10. The encoder is responsible for adapting the incoming audio data rate to a bitrate level at which the bandwidth conditions in the transmission channel are not violated. Ideally, the encoder 10 discards only irrelevant information from the audio signal in this encoding process. The encoded audio signal is then transmitted by the transmitting side of the audio coding system and received at the receiving side of the audio coding system. The decoder 11 at the receiving side reverses the encoding process to obtain a decoded audio signal with little or no audible degradation.

Alternatively, the audio coding system of FIG. 1 could be employed for archiving audio data. In that case, the encoded audio data provided by the encoder 10 is stored in some storage unit, and the decoder 11 decodes audio data retrieved from this storage unit. In this alternative, it is the target that the encoder achieves a bitrate which is as low as possible, in order to save storage space.

The original audio signal which is to be processed can be a mono audio signal or a multichannel audio signal containing at least a first and a second channel signal. An example of a multichannel audio signal is a stereo audio signal, which is composed of a left channel signal and a right channel signal.

Depending on the allowed bitrate, different encoding schemes can be applied to a stereo audio signal. The left and right channel signals can be encoded for instance independently from each other. But typically, a correlation exists between the left and the right channel signals, and the most advanced coding schemes exploit this correlation to achieve a further reduction in the bitrate.

Particularly suited for reducing the bitrate are low bitrate stereo extension methods. In a stereo extension method, the stereo audio signal is encoded as a high bitrate mono signal, which is provided by the encoder together with some side information reserved for a stereo extension. In the decoder, the stereo audio signal is then reconstructed from the high bitrate mono signal in a stereo extension making use of the side information. The side information typically takes only a few kbps of the total bitrate.

If a stereo extension scheme aims at operating at low bitrates, an exact replica of the original stereo audio signal cannot be obtained in the decoding process. For the thus required approximation of the original stereo audio signal, an efficient coding model is necessary.

The most commonly used stereo audio coding schemes are Mid Side (MS) stereo and Intensity Stereo (IS).

In MS stereo, the left and right channel signals are transformed into sum and difference signals, as described for example by J. D. Johnston and A. J. Ferreira in "Sum-difference stereo transform coding", ICASSP-92 Conference Record, 1992, pp. 569-572. For a maximum coding efficiency, this transformation is done in both, a frequency and a time dependent manner. MS stereo is especially useful for high quality, high bitrate stereophonic coding.

In the attempt to achieve lower bitrates, IS has been used in combination with this MS coding, where IS constitutes a stereo extension scheme. In IS coding, a portion of the spectrum is coded only in mono mode, and the stereo audio signal is reconstructed by providing in addition different scaling factors for the left and right channels, as described for instance in documents U.S. Pat. No. 5,539,829 and U.S. Pat. No. 5,606,618.

Two further, very low bitrate stereo extension schemes have been proposed with Binaural Cue Coding (BCC) and Bandwidth Extension (BWE). In BCC, described by F. Baumgarte and C. Faller in "Why Binaural Cue Coding is Better than Intensity Stereo Coding, AES112th Convention, May 10-13, 2002, Preprint 5575, the whole spectrum is coded with IS. In BWE coding, described in ISO/IEC JTC1/SC29/WG11 (MPEG-4), "Text of ISO/IEC 14496-3:2001/FPDAM 1, Bandwidth Extension", N5203 (output document from MPEG 62nd meeting), October 2002, a bandwidth extension is used to extend the mono signal to a stereo signal.

Moreover, document U.S. Pat. No. 6,016,473 proposes a low bit-rate spatial coding system for coding a plurality of audio streams representing a soundfield. On the encoder side, the audio streams are divided into a plurality of subband signals, representing a respective frequency subband. Then, a composite signal representing the combination of these subband signals is generated. In addition, a steering control signal is generated, which indicates the principal direction of the soundfield in the subbands, e.g. in form of weighted vectors. On the decoder side, an audio stream in up to two channels is generated based on the composite signal and the associated steering control signal.

SUMMARY OF THE INVENTION

It is an object of the invention to support the extension of a mono audio signal to a multichannel audio signal based on side information in an efficient way.

For the encoding end of a multichannel audio coding system, a first method for supporting a multichannel audio extension is proposed. The proposed first method comprises on the one hand generating and providing first multichannel extension information at least for higher frequencies of a multichannel audio signal, which first multichannel extension information allows to reconstruct at least the higher frequencies of the multichannel audio signal based on a mono audio signal available for the multichannel audio signal. The proposed second method comprises on the other hand generating and providing second multichannel extension information for lower frequencies of the multichannel audio signal, which second multichannel extension information allows to reconstruct the lower frequencies of the multichannel audio signal based on the mono audio signal with a higher accuracy than the first multichannel extension information allows to reconstruct at least the higher frequencies of the multichannel audio signal.

In addition, a multichannel audio encoder and an extension encoder for a multichannel audio encoder are proposed, which comprise means for realizing the first proposed method.

For the decoding end of a multichannel audio coding system, a complementary second method for supporting a multichannel audio extension is proposed. The proposed second method comprises on the one hand reconstructing at least higher frequencies of a multichannel audio signal based on a received mono audio signal for the multichannel audio signal and on received first multichannel extension information for the multichannel audio signal. The proposed second method comprises on the other hand reconstructing lower frequencies of the multichannel audio signal based on the received mono audio signal and on received second multichannel extension information with a higher accuracy than the higher frequencies. The second proposed method further comprises a step of combining the reconstructed higher frequencies and the reconstructed lower frequencies to a reconstructed multichannel audio signal.

In addition, a multichannel audio decoder and an extension decoder for a multichannel audio decoder are proposed, which comprise means for realizing the second proposed method.

Finally, a multichannel audio coding system is proposed, which comprises as well the proposed multichannel audio encoder as the proposed multichannel audio decoder.

The invention proceeds from the consideration that at low frequencies, the human auditory system is very critical and sensitive regarding a stereo perception. Stereo extension methods which result in relatively low bitrates perform best at mid and high frequencies, at which the spatial hearing relies mostly on amplitude level differences. They are not able to reconstruct the low frequencies at an accuracy level which is required for a good stereo perception. It is therefore proposed that the lower frequencies of a multichannel audio signal are encoded with a higher efficiency than the higher frequencies of the multichannel audio signal. This is achieved by providing a general multichannel extension information for the entire multichannel audio signal or for the higher frequencies of the multichannel audio signal, and by providing in addition a dedicated multichannel extension information for the lower frequencies, where the dedicated multichannel extension information enables a more accurate reconstruction than the general multichannel extension information.

It is an advantage of the invention that it allows an efficient encoding of the important low frequencies as needed for a good stereo output, while avoiding at the same time a general increase of required bits for the entire frequency spectrum.

The invention provides an extension of known solutions with a moderate additional complexity.

Preferred embodiments of the invention become apparent from the dependent claims.

The multichannel audio signal can be in particular, though not exclusively, a stereo audio signal having a left channel signal and a right channel signal. In case the multichannel audio signal comprises more than two channels, the first and second multichannel extension information may be provided for respective channel pairs.

In an advantageous embodiment, the first and the second multichannel extension information are both generated in the frequency domain, and also the reconstruction of the higher and the lower frequencies and the combining of the reconstructed higher and lower frequencies is performed in the frequency domain.

The required transformations from the time domain into the frequency domain and from the frequency domain into the time domain can be achieved with different types of transforms, for example with a Modified Discrete Cosine Transform (MDCT) and an Inverse MDCT (IMDCT), with a Fast Fourier Transform (FFT) and an Inverse FFT (IFFT) or with a Discrete Cosine Transform (DCT) and an Inverse DCT (IDCT). The MDCT has been described in detail e.g. by J. P. Princen, A. B. Bradley in "Analysis/synthesis filter bank design based on time domain aliasing cancellation", IEEE Trans. Acoustics, Speech, and Signal Processing, 1986, Vol. ASSP-34, No. 5, October 1986, pp. 1153-1161, and by S. Shlien in "The modulated lapped transform, its time-varying forms, and its applications to audio coding standards", IEEE Trans. Speech, and Audio Processing, Vol. 5, No. 4, July 1997, pp. 359-366.

The invention can be used with various codecs, in particular, though not exclusively, with Adaptive Multi-Rate Wideband extension (AMR-WB+), which is suited for high audio quality.

The invention can further be implemented either in software or using a dedicated hardware solution. Since the enabled multichannel audio extension is part of a coding system, it is preferably implemented in the same way as the overall coding system.

The invention can be employed in particular for storage purposes and for transmissions, e.g. to and from mobile terminals.

BRIEF DESCRIPTION OF THE FIGURES

Other objects and features of the present invention will become apparent from the following detailed description of an exemplary embodiment of the invention considered in conjunction with the accompanying drawings.

DETAILED DESCRIPTION OF THE INVENTION

Figure 1:
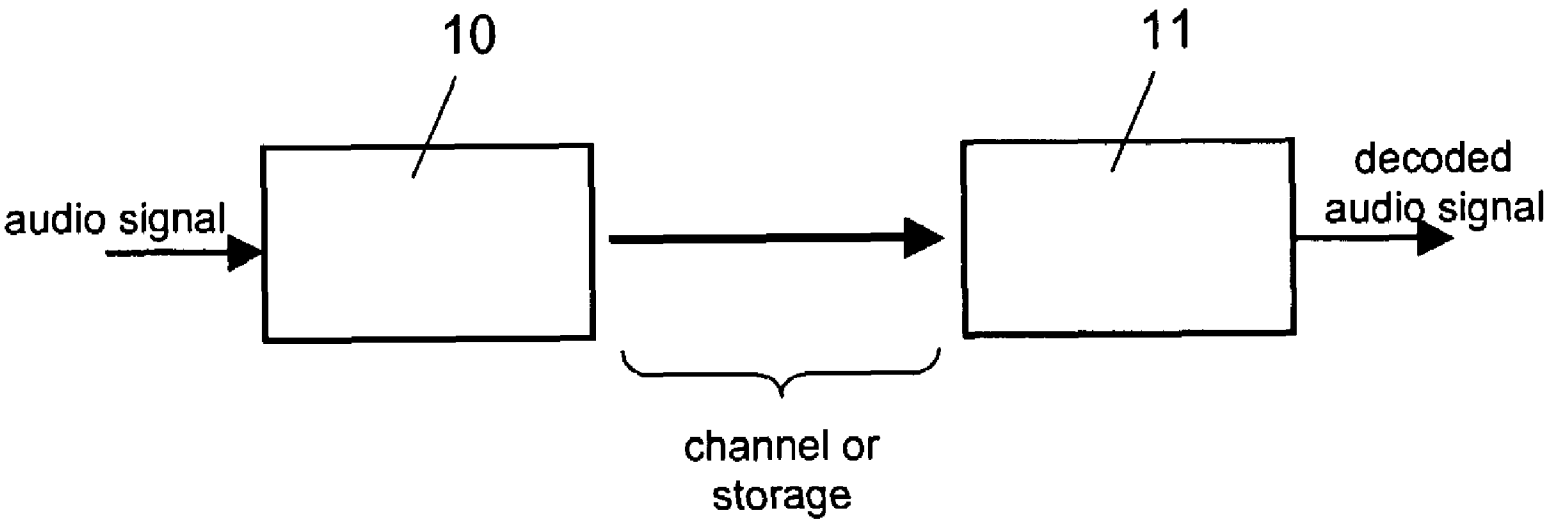
FIG. 1 is a block diagram presenting the general structure of an audio coding system.

FIG. 1 has already been described above.

An embodiment of the invention will be described with reference to FIGS. 2 to 4.

Figure 2:
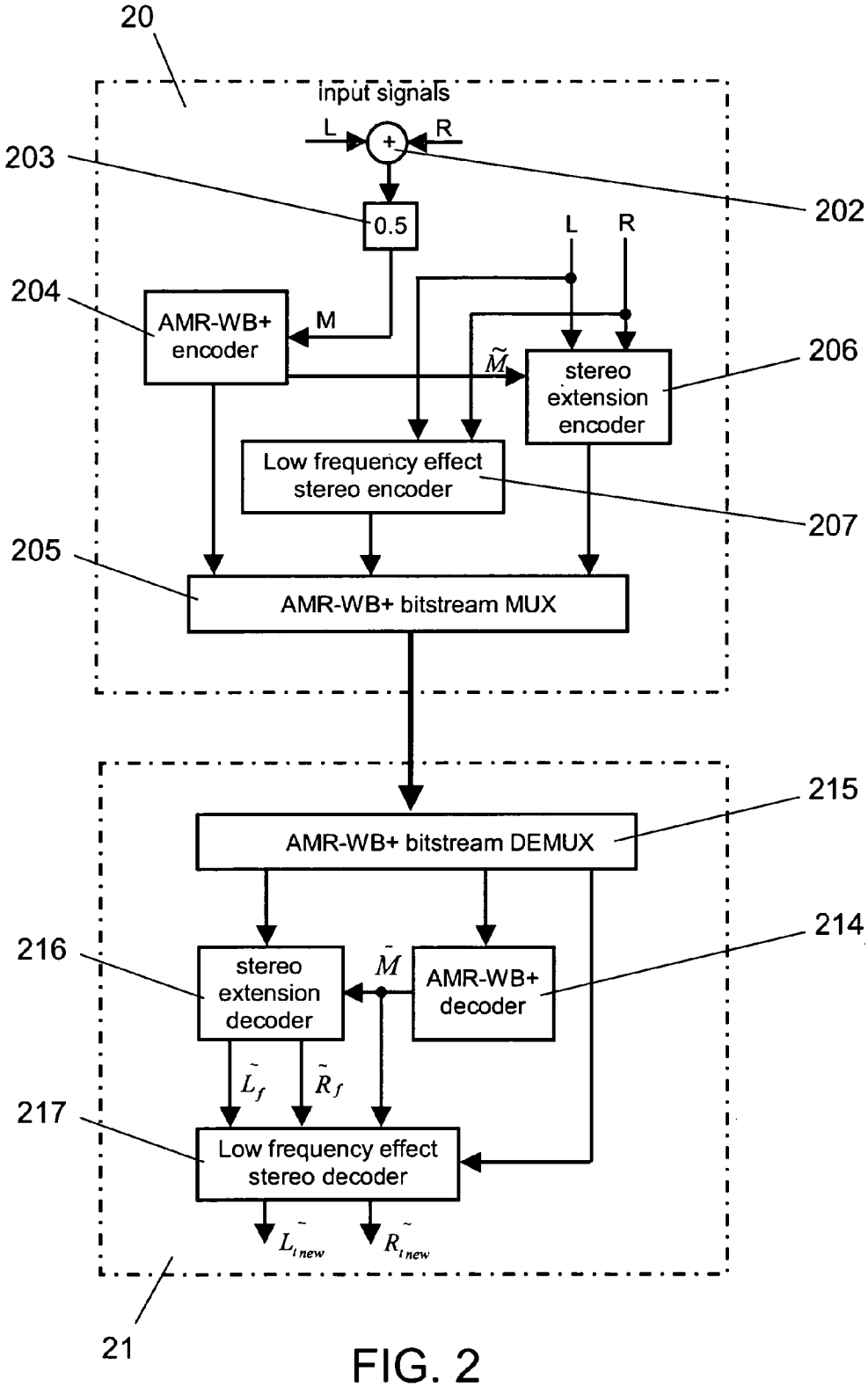
FIG. 2 is a high level block diagram of a an embodiment of a stereo audio coding system according to the invention.

FIG. 2 presents the general structure of an embodiment of a stereo audio coding system according to the invention. The stereo audio coding system can be employed for transmitting a stereo audio signal which is composed of a left channel signal and a right channel signal.

The stereo audio coding system of FIG. 2 comprises a stereo encoder 20 and a stereo decoder 21. The stereo encoder 20 encodes stereo audio signals and transmits them to the stereo decoder 21, while the stereo decoder 21 receives the encoded signals, decodes them and makes them available again as stereo audio signals. Alternatively, the encoded stereo audio signals could also be provided by the stereo encoder 20 for storage in a storing unit, from which they can be extracted again by the stereo decoder 21.

The stereo encoder 20 comprises a summing point 202, which is connected via a scaling unit 203 to an AMR-WB+ mono encoder component 204. The AMR-WB+ mono encoder component 204 is further connected to an AMR-WB+ bitstream multiplexer (MUX) 205. In addition, the stereo encoder 20 comprises a stereo extension encoder 206 and a low frequency effect stereo encoder 207, which are both connected to the AMR-WB+ bitstream multiplexer 205 as well. The AMR-WB+ mono encoder component 204 may moreover be connected to the stereo extension encoder 206. The stereo encoder 20 constitutes an embodiment of the multichannel audio encoder according to the invention, while the stereo extension encoder 206 and the low frequency effect stereo encoder 207 form together an embodiment of the extension encoder according to the invention.

The stereo decoder 21 comprises an AMR-WB+ bitstream demultiplexer (DEMUX) 215, which is connected to an AMR-WB+ mono decoder component 214, to a stereo extension decoder 216 and to a low frequency effect stereo decoder 217. The AMR-WB+ mono decoder component 214 is further connected to the stereo extension decoder 216 and to the low frequency effect stereo decoder 217. The stereo extension decoder 216 is equally connected to the low frequency effect stereo decoder 217. The stereo decoder 21 constitutes an embodiment of the multichannel audio decoder according to the invention, while the stereo extension decoder 216 and the low frequency effect stereo decoder 217 form together an embodiment of the extension decoder according to the invention.

When a stereo audio signal is to be transmitted, the left channel signal L and the right channel signal R of the stereo audio signal are provided to the stereo encoder 20. The left channel signal L and the right channel signal R are assumed to be arranged in frames.

The left and right channel signals L, R are summed by the summing point 202 and scaled by a factor 0.5 in the scaling unit 203 to form a mono audio signal M. The AMR-WB+ mono encoder component 204 is then responsible for encoding the mono audio signal in a known manner to obtain a mono signal bitstream.

The left and right channel signals L, R provided to the stereo encoder 20 are moreover processed in the stereo extension encoder 206, in order to obtain a bitstream containing side information for a stereo extension. In the presented embodiment, the stereo extension encoder 206 generates this side information in the frequency domain, which is efficient for mid and high frequencies, and requires at the same time a low computational load and results in a low bitrate. This side information constitutes a first multichannel extension information.

The stereo extension encoder 206 first transforms the received left and right channel signals L, R by means of an MDCT into the frequency domain to obtain spectral left and right channel signals. Then, the stereo extension encoder 206 determines for each of a plurality of adjacent frequency bands whether the spectral left channel signal, the spectral right channel signal or none of these signals is dominant in the respective frequency band. Finally, the stereo extension encoder 206 provides a corresponding state information for each of the frequency bands in a side information bitstream.

In addition, the stereo extension encoder 206 may include various supplementary information in the provided side information bitstream. For example, the side information bitstream may comprise level modification gains which indicate the extend of the dominance of the left or right channel signals in each frame or even in each frequency band of each frame. Adjustable level modification gains allow a good reconstruction of the stereo audio signal within the frequency bands when proceeding from the mono audio signal M. Equally, a quantization gain employed for quantizing such level modification gains may be included. Further, the side information bitstream may comprise an enhancement information which reflects on a sample basis the difference between the original left and right channel signals on the one hand and left and right channel signals which are reconstructed based on the provided side information on the other hand. For enabling such a reconstruction on the encoder side, the AMR-WB+ mono encoder component 204 provides the mono audio signal $\tilde{M}$ as well to the stereo extension encoder 206. The bitrate employed for the enhancement information and thus the quality of the enhancement information can be adjusted to the respectively available bitrate. Also an indication of a coding scheme employed for encoding any information included in the side information bitstream may be provided.

The left and right channel signals L, R provided to the stereo encoder 20 are further processed in the low frequency effect stereo encoder 207 to obtain in addition a bitstream containing low frequency data enabling a stereo extension specifically for the lower frequencies of the stereo audio signal, as will be explained in more detail further below. This low frequency data constitutes a second multichannel extension information.

The bitstreams provided by the AMR-WB+ mono encoder component 204, the stereo extension encoder 206 and the low frequency effect stereo encoder 207 are then multiplexed by the AMR-WB+ bitstream multiplexer 205 for transmission.

The transmitted multiplexed bitstream is received by the stereo decoder 21 and demultiplexed by the AMR-WB+ bitstream demultiplexer 215 into a mono signal bitstream, a side information bitstream and a low frequency data bitstream again. The mono signal bitstream is forwarded to the AMR-WB+ mono decoder component 214, the side information bitstream is forwarded to the stereo extension decoder 216 and the low frequency data bitstream is forwarded to the low frequency effect stereo decoder 217.

The mono signal bitstream is decoded by the AMR-WB+ mono decoder component 214 in a known manner. The resulting mono audio signal $\tilde{M}$ is provided to the stereo extension decoder 216 and to the low frequency effect stereo decoder 217.

The stereo extension decoder 216 decodes the side information bitstream and reconstructs the original left channel signal and the original right channel signal in the frequency domain by extending the received mono audio signal $\tilde{M}$ based on the obtained side information and based on any supplementary information included in the received side information bitstream. In the presented embodiment, for example, the spectral left channel signal $\tilde{L}_f$ in a specific frequency band is obtained by using the mono audio signal $\tilde{M}$ in this frequency band in case the state flags indicate no dominance for this frequency band, by multiplying the mono audio signal $\tilde{M}$ in this frequency band with a received gain value in case the state flags indicate a dominance of the left channel signal for this frequency band, and by dividing the mono audio signal $\tilde{M}$ in this frequency band by a received gain value in case the state flags indicate a dominance of the right channel signal for this frequency band. The spectral right channel signal $\tilde{R}_f$ for a specific frequency band is obtained in a corresponding manner. In case the side information bitstream comprises enhancement information, this enhancement information can be used for improving the reconstructed spectral channel signals on a sample by sample basis.

The reconstructed spectral left and right channel signals $\tilde{L}_f$ and $\tilde{R}_f$ are then provided to the low frequency effect stereo decoder 217.

The low frequency effect stereo decoder 217 decodes the low frequency data bitstream containing the side information for the low frequency stereo extension and reconstructs the original low frequency channel signals by extending the received mono audio signal $\tilde{M}$ based on the obtained side information. Then, the low frequency effect stereo decoder 217 combines the reconstructed low frequency bands with the higher frequency bands of the left channel signal $\tilde{L}_f$ and the right channel signal $\tilde{R}_f$ provided by the stereo extension decoder 216.

Finally, the resulting spectral left and right channel signals are converted by the low frequency effect stereo decoder 217 into the time domain and output by the stereo decoder 21 as reconstructed left and right channel signals $\tilde{L}_{new}$ and $\tilde{R}_{new}$ of the stereo audio signal.

The structure and the operation of the low frequency effect stereo encoder 207 and the low frequency effect stereo decoder 217 will be presented in the following with reference to FIGS. 3 and 4.

Figure 3:
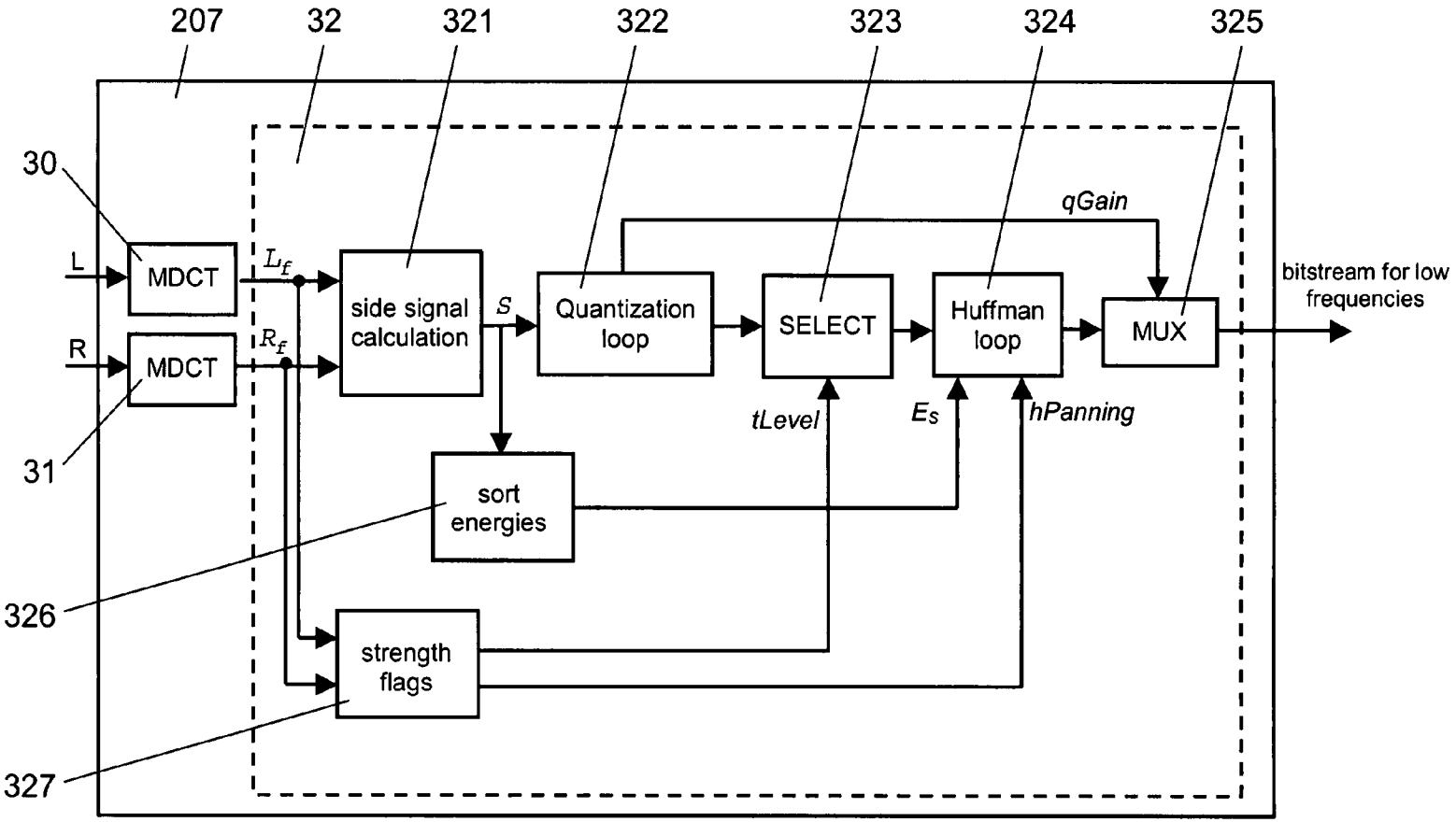
FIG. 3 is a block diagram illustrating a low frequency effect stereo encoder of the stereo audio coding system of FIG. 2.

FIG. 3 is a schematic block diagram of the low frequency stereo encoder 207.

The low frequency stereo encoder 207 comprises a first MDCT portion 30, a second MDCT portion 31 and a core low frequency effect encoder 32. The core low frequency effect encoder 32 comprises a side signal generating portion 321, and the output of the first MDCT portion 30 and the second MDCT portion 31 are connected to this side signal generating portion 321. Within the core low frequency effect encoder 32, the side signal generating portion 321 is connected via a quantization loop portion 322, a selection portion 323 and a Huffman loop portion 324 to a multiplexer MUX 325. The side signal generating portion 321 is connected in addition via a sorting portion 326 to the Huffman loop portion 324. The quantization loop portion 322 is moreover connected as well directly to the multiplexer 325. The low frequency stereo encoder 207 further comprises a flag generation portion 327, and the output of the first MDCT portion 30 and the second MDCT portion 31 are equally connected to this flag generation portion 327. Within the core low frequency effect encoder 32, the flag generation portion 327 is connected to the selection portion 323 and to the Huffman loop portion 324. The output of the multiplexer 325 is connected via the output of the core low frequency effect encoder 32 and the output of the low frequency effect stereo encoder 207 to the AMR-WB+ bitstream multiplexer 205.

A left channel signal L received by the low frequency effect stereo encoder 207 is first transformed by the first MDCT portion 30 by means of a frame based MDCT into the frequency domain, resulting in a spectral left channel signal $L_f$. In parallel, a received right channel signal R is transformed by the second MDCT portion 31 by means of a frame based MDCT into the frequency domain, resulting in a spectral right channel signal $R_f$. The obtained spectral channel signals are then provided to the side signal generating portion 321.

Based on the received spectral left and right channel signals $L_f$ and $R_f$, the side signal generating portion 321 generates a spectral side signal S according to the following equation:

$$S(i-M)=\frac{L_f(i)-R_f(i)}{2},\ M\le i<N, \tag{1}$$

where i is an index identifying a respective spectral sample, and where M and N are parameters which describe start and end indices of the spectral samples to be quantized. In the current implementation the values M and N are set to 4 and 30, respectively. Thus, the side signal S comprises only values for N−M samples of the lower frequency bands. In case of an exemplary total number of 27 frequency bands with a sample distribution in the frequency bands of {3, 3, 3, 3, 3, 3, 3, 4, 4, 5, 5, 5, 6, 6, 7, 7, 8, 9, 9, 10, 11, 14, 14, 15, 15, 17, 18}, the side signal S would thus be generated for samples in the $2^{nd}$ to the $10^{th}$ frequency band.

The generated spectral side signal S is fed on the one hand to the sorting portion 326.

The sorting portion 326 calculates the energies of the spectral samples of the side signal S according to the following equation:

$$E_S(i)=S(i)\cdot S(i),\ 0\leqq i<N-M \tag{2}$$

The sorting portion 326 then sorts the resulting energy array in a decreasing order of the calculated energies $E_S(i)$ by a function SORT($E_S$). A helper variable is also used in the sorting operation to make sure that the core low frequency effect encoder 32 knows to which spectral location the first energy in the sorted array corresponds to, to which spectral location the second energy in the sorted array corresponds to, and so on. This helper variable is not explicitly indicated.

The sorted energy array $E_S$ is provided by the sorting portion 326 to the Huffman loop portion 324.

The spectral side signal S generated by the side signal generating portion 321 is fed on the one hand to the quantization loop portion 322.

The side signal S is quantized by the quantization loop portion 322 such that the maximum absolute value of the quantized samples lies below some threshold value T. In the presented embodiment, the threshold value T is set to 3. The quantizer gain required for this quantization is associated to the quantized spectrum for enabling a reconstruction of the spectral side signal S at the decoder.

To speed up the quantization, an initial quantizer value $g_{start}$ is calculated as follows:

$$g_{start}=5.3\cdot\log_2\left(\frac{|\max(S(i))|^{0.75}}{1024}\right),\ 0\le i<N-M \tag{3}$$

In this equation, max is a function which returns the maximum value of the inputted array, i.e. in this case the maximum value of all samples of the spectral side signal S.

Next, the quantizer value $g_{start}$ is increased in a loop until all values of the quantized spectrum are below the threshold value T.

In a particularly simple quantization loop, first, the spectral side signal S is quantized according to the following equation to obtain the quantized spectral side signal $\hat{S}$:

$$q=(|S(i)|\cdot 2^{-0.25\cdot g_{start}})^{0.75},\ 0\leqq i<N-M$$

$$\hat{S}(i)=\lfloor(q+0.2554)\cdot\mathrm{sign}(S(i))\rfloor \tag{4}$$

$$\text{sign}(x) = \begin{cases} -1, & \text{if } x \le 0 \\ 1, & \text{otherwise} \end{cases}$$

Now, the maximum absolute value of the resulting quantized spectral side signal $\hat{S}$ is determined. If this maximum absolute value is smaller than the threshold value T, then the current quantizer value $g_{start}$ constitutes the final quantizer gain qGain. Otherwise, the current quantizer value $g_{start}$ is incremented by one, and the quantization according to equation (4) is repeated with the new quantizer value $g_{start}$, until the maximum absolute value of the resulting quantized spectral side signal $\hat{S}$ is smaller than the threshold value T.

In a more efficient quantization loop, which is employed in the presented embodiment, the quantizer value $g_{start}$ is changed first in larger steps in order to speed up the process, as indicated by the following pseudo C code.

Quantization Loop 2:
stepSize=A;
bigSteps=TRUE;
fineSteps=FALSE;
Start:
Quantize S using Equation (4);
Find maximum absolute value of the quantized specta $\hat{S}$

```
If (max absolute value of Ŝ < T) {
   bigSteps = FALSE;
   If (fineSteps == TRUE)
      goto exit;
   else
   {
      fineSteps = TRUE;
         g_start = g_start − stepSize
   }
   } else {
         If (bigSteps == TRUE)
            g_start = g_start + stepSize
         else
            g_start = g_start + 1
   }
      goto start:
exit;
```

Thus, the quantizer value $g_{start}$ is increased in steps of step size A, as long as the maximum absolute value of the resulting quantized spectral side signal $\hat{S}$ is not smaller than the threshold value T. Once the maximum absolute value of the resulting quantized spectral side signal $\hat{S}$ is smaller than the threshold value T, the quantizer value $g_{start}$ is decreased again by step size A, and then, the quantizer value $g_{start}$ is incremented by one, until the maximum absolute value of the resulting quantized spectral side signal $\hat{S}$ is again smaller than the threshold value T. The last quantizer value $g_{start}$ in this loop then constitutes the final quantizer value qGain. In the presented embodiment, step size A is set to 8. Further, the final quantizer gain qGain is encoded with 6 bits, the range for the gain being from 22 to 85. If the quantizer gain qGain is smaller than the minimum allowed gain value, the samples of the quantized spectral side signal $\hat{S}$ are set to zero.

After the spectrum has been quantized below the threshold value T, the quantized spectral side signal $\hat{S}$ and the employed quantizer gain qGain are provided to the selection portion 323. In the select portion 323, the quantized spectral side signal $\hat{S}$ is modified such that only spectral areas having a significant contribution to the creation of the stereo image are taken into account. All samples of the quantized spectral side signal $\hat{S}$ which do not lie in a spectral area having a significant contribution to the creation of the stereo image are set to zero. The modification is performed according to the following equations:

$$\hat{S}(i) = \begin{cases} \hat{S}(i), & \text{if } C = \text{TRUE} \\ 0, & \text{otherwise} \end{cases}, \; 0 \le i < N - M \tag{5}$$

$$C = \begin{cases} \text{TRUE}, & \text{if } |\hat{S}(i)| = 1 \text{ and } |\hat{S}(i-1)| = 0 \text{ and } |\hat{S}(i+1)| = 0 \text{ and} \\ & |\hat{S}_{n-1}(i)| = 0 \text{ and } |\hat{S}_{n-1}(i-1)| = 0 \text{ and } |\hat{S}_{n-1}(i+1)| = 0 \text{ and} \\ & |\hat{S}_{n+1}(i)| = 0 \text{ and } |\hat{S}_{n+1}(i-1)| = 0 \text{ and } |\hat{S}_{n+1}(i+1)| = 0 \\ \text{FALSE}, & \text{otherwise} \end{cases}$$

where $\hat{S}_{n-1}$ and $\hat{S}_{n+1}$ are the quantized spectral samples from the previous and the next frame, respectively, with respect to current frame. The spectral samples outside of the range $0 \leqq i < N-M$ are assumed to have a value of zero. The quantized samples for the next frame are obtained via lookahead coding, where the samples of the next frame are always quantized below the threshold value T but subsequent Huffman encoding loop is applied to the quantized samples preceding that frame.

If the average energy level tLevel of the spectral left and right channel signal is below a predetermined threshold value, all samples of the quantized spectral side signal $\hat{S}$ are set to zero:

$$\hat{S}(i) = \begin{cases} \hat{S}(i), & \text{if } tLevel \ge 6000 \\ 0, & \text{otherwise} \end{cases}, \; 0 \le i < N - M \tag{6}$$

The value tLevel is generated in the flag generation portion 327 and provided to the selection portion 323, as will be explained further below.

The modified quantized spectral side signal $\hat{S}$ is provided by the selection portion 323 to the Huffman loop portion 324 together with the quantizer gain qGain received from the quantization loop portion 322.

Meanwhile, the flag generating portion 327 generates for each frame a spatial strength flag indicating for the lower frequencies whether a dequantized spectral side signal should belong entirely to the left or the right channel or whether it should be evenly distributed to the left and the right channel.

The spatial strength flag, hPanning, is calculated as follows:

$$hPanning = \begin{cases} 2, & \text{if } A = \text{TRUE and } eR > eL \text{ and } B = \text{TRUE} \\ 1, & f\ A = \text{TRUE and } eL \geq eR \text{ and } B = \text{TRUE} \\ 0, & \text{otherwise} \end{cases} \quad (7)$$

with $$wL = \sum_{i=M}^{N-1} L_f(i) \cdot L_f(i) \quad wR = \sum_{i=M}^{N-1} R_f(i) \cdot R_f(i)$$

$$eL = \frac{\sqrt{wL}}{N-M} \quad eR = \frac{\sqrt{wR}}{N-M}$$

$$B = \begin{cases} \text{TRUE}, & eLR > 13.38 \text{ and } tLevel < 3000 \\ \text{FALSE}, & \text{otherwise} \end{cases}$$

$$eLR = \begin{cases} eR/eL, & \text{if } eR > eL \\ eL/eR, & \text{otherwise} \end{cases} \quad tLevel = \sqrt{\frac{eL + eR}{N-M}}$$

The spatial strength is also calculated for the samples of the respective frame preceding and following the current frame. These spatial strengths are taken into account for calculating final spatial strength flags for the current frame as follows:

$$hPanning = \begin{cases} hPanning_{n-1}, & \text{if } A = \text{TRUE} \\ hPanning, & \text{otherwise} \end{cases} \quad (8)$$

$$A = \begin{cases} \text{TRUE}, & hPanning_{n-1} \mathrel{!=} hPanning \text{ and } hPanning \mathrel{!=} hPanning_{n+1} \\ \text{FALSE}, & \text{otherwise} \end{cases}$$

where $hPanning_{n-1}$ and $hPanning_{n+1}$ are the spatial strength flags of the previous and the next frame, respectively. Thereby, it is ensured that consistent decisions are made across frames.

A resulting spatial strength flag hPanning of '0' indicates for a specific frame that the stereo information is evenly distributed across the left and the right channel, a resulting spatial strength flag of '1' indicates for a specific frame that the left channel signal is considerably stronger than the right channel signal, and a spatial strength flag of '2' indicates for a specific frame that the right channel signal is considerably stronger than the left channel signal.

The obtained spatial strength flag hPanning is encoded such that a '0' bit represents a spatial strength flag hPanning of '0' and that a '1' bit indicates that either the left or the right channel signal should be reconstructed using the dequantized spectral side signal. In the latter case, one additional bit will follow, where a '0' bit represents a spatial strength flag hPanning of '2' and where a '1' bit represents a spatial strength flag hPanning of '1'.

The flag generating portion 327 provides the encoded spatial strength flags to the Huffman loop portion 324. Moreover, the flag generating portion 327 provides the intermediate value tLevel from equation (7) to the selection portion 323, where it is used in equation (6) as described above.

The Huffman loop portion 324 is responsible for adapting the samples of the modified quantized spectral side signal $\hat{S}$ received from the selection portion 323 in a way that the number of bits for the low frequency data bitstream is below the number of allowed bits for a respective frame.

In the presented embodiment, three different Huffman encoding schemes are used for enabling an efficient coding of the quantized spectral samples. For each frame, the quantized spectral side signal $\hat{S}$ is encoded with each of the coding schemes, and then, the coding scheme is selected which results in the lowest number of required bits. A fixed bit allocation would result only in a very sparse spectrum with only few nonzero spectral samples.

The first Huffman coding scheme (HUF1) encodes all available quantized spectral samples, except those having a value of zero, by retrieving a code associated to the respective value from a Huffman table. Whether a sample has a value of zero or not is indicated by a single bit. The number of bits out_bits required with this first Huffman coding scheme are calculated with the following equations:

$$\text{out_bits} = \sum_{i=0}^{N-M-1} \begin{cases} 1, & \text{if } \hat{S}(i) = 0 \\ 1 + hufLowCoefTable\,[a][0], & \text{otherwise} \end{cases} \quad (9)$$

$$a = \begin{cases} \hat{S}(i) + 3, & \text{if } \hat{S}(i) < 0 \\ \hat{S}(i) + 2 & \text{otherwise} \end{cases}$$

In these equations, a is an amplitude value between 0 and 5, to which a respective quantized spectral sample value $\hat{S}(i)$, lying between −3 and +3, is mapped, the value of zero being excluded. The hufLowCoefTable defines for each of the six possible amplitude values a a Huffman codeword length as a respective first value and an associated Huffman codeword a respective second value, as shown in the following table:

hufLowCoefTable[6][2]={{3, 0}, {3, 3}, {2, 3}, {2, 2}, {3, 2}, {3, 1}}.

In equation (9), the value of hufLowCoefTable[a][0] is given by the Huffman codeword length defined for the respective amplitude value a, i.e. it is either 2 or 3.

For transmission, the bitstream resulting with this coding scheme is organized such that it can be decoded based on the following syntax:

```
HUF1_Decode(int16 *S_dec)
{
for(i =M; i < N; i++)
  {
  int16 sBinPresent= BsGetBits(1);
    if(sBinPresent == 1)
      S_dec[i] = 0;
    else
    {
        int16 q =
HufDecodeSymbol (hufLowCoefTable);
        q = (q > 2) ? q − 2 : q − 3;
        S_dec[i] = q;
    }
  }
}
```

In this syntax, BsGetBits(n) reads n bits from the bitstream buffer. sBinPresent incicates whether a code is present for a specific sample index, HufDecodeSymbol( ) decodes the next Huffman codeword from the bitstream and returns the symbol that corresponds to this codeword, and S_dec[i] is a respective decoded quantized spectral sample value.

The second Huffman coding scheme (HUF2) encodes all quantized spectral samples, including those having a value of zero, by retrieving a code associated to the respective value from a Huffman table. However, in case the sample with the highest index has a value of zero, this sample and all consecutively neighboring samples having a value of zero are excluded from the coding. The highest index of the not excluded samples is coded with 5 bits. The number of bits out_bits required with the second Huffman coding scheme (HUF2) are calculated with the following equations:

$$\text{out_bits} = 5 + \sum_{i=0}^{last_bin} \text{hufLowCoefTable_12}\left[\hat{S}(i) + 3\right][0] \tag{10}$$

$$\text{last_bin} = \begin{cases} i, & \text{if } S(i) \,!= 0 \\ \text{continue to next } i, & \text{otherwise} \end{cases}, \quad N - M - 1 \le i \le 0$$

In these equations, last_bin defines the highest index of all samples which are encoded. The HufLowCoefTable_12 defines for each amplitude value between 0 and 6, obtained by adding a value of three to the respective quantized sample value $\hat{S}(i)$, a Huffman codeword length and an associated Huffman codeword as shown in the following table:

hufLowCoefTable_12[7][2]={{4, 8}, {4, 10}, {2, 1}, {2, 3}, {2, 0}, {4, 11}, {4, 9}}.

For transmission, the bitstream resulting with this coding scheme is organized such that it can be decoded based on the following syntax:

```
HUF2_Decode(int16 *S_dec)
{
int16 last_bin = BsGetBits(5) ;
for(i=M; i < last_bin; i++)
   S_dec[i] =
HufDecodeSymbol(hufLowCoefTable_12) – 3;
}
```

Also in this syntax, BsGetBits(n) reads n bits from the bitstream buffer. HufDecodeSymbol( ) decodes the next Huffman codeword from the bitstream and returns the symbol that corresponds to this codeword, and S_dec[i] is a respective decoded quantized spectral sample value.

The third Huffman coding scheme (HUF3) encodes consecutive runs of zero of quantized spectral sample values separately from non-zero quantized spectral sample values, in case less than 17 sample values are non-zero values. The number of non-zero values in a frame is indicated by four bits. The number of bits out_bits required with this third and last Huffman coding scheme are calculated with the following equations:

$$\text{out_bits} = 5 + \begin{cases} \min(\text{out_bits0}, \text{out_bits1}), & \text{if nonZeroCount} < 17 \\ 10000, & \text{otherwise} \end{cases} \tag{11}$$

$$\text{nonZeroCount} = \sum_{i=0}^{N-M-1} \begin{cases} 1, & \hat{S}(i) \,!= 0 \\ 0, & \text{otherwise} \end{cases}$$

with

```
(out_bits0 = 0; out_bits1 = 0;
for (i = M; i < N; i++)
{
    int16 zeroRun = 0;
    /*-- Count the zero-run length. --*/
    for( ; i < N; i++)
```

-continued

```
    {
        if (S^[i]  == 0)
            zeroRun++;
        else
            break;
    }
    if(! (i == N  &&  S^[i – 1]  == 0))
    {
        int16 qCoef;
        /*-- Huffman codeword for zero-run
section. --*/
        out_bits0 +=hufLowTable2 [zeroRun] [0];
        out_bits1 +=hufLowTable3 [zeroRun] [0];
        /*-- Huffman codeword for nonzero
amplitude. --*/
        qCoef = (S^[i] < 0)  ?  S^[i] + 3 : S^[i] + 2;
        out_bits0 += hufLowCoefTable [qCoef] [0];
        out_bits1 += hufLowCoefTable [qCoef] [0];
    }
}
```

The HufLowTable2 and the HufLowTable3 both define Huffman codeword lengths and associated Huffman codewords for zero-run sections within the spectrum. That is, two tables with different statistical distribution are provided for the coding of zero-runs present in the spectrum. The two tables are presented in the following:

*hufLowTable2* [25] [2] =

{{1, 1}, {2, 0}, {4, 7}, {4, 4}, {5, 11}, {6, 27}, {6, 21}, {6, 20}, {7, 48}, {8, 98}, {9, 215}, {9, 213}, {9, 212}, {9, 205}, {9, 204}, {9, 207}, {9, 206}, {9, 201}, {9, 200}, {9, 203}, {9, 202}, {9, 209}, {9, 208}, {9, 211}, {9, 210}}.

*hufLowTable3* [25] [2] = {{1, 0}, {3, 6}, {4, 15}, {4, 14}, {4, 9}, {5, 23}, {5, 22}, {5, 20}, {5, 16}, {6, 42}, {6, 34}, {7, 86}, {7, 70}, {8, 174}, {8, 142}, {9, 350}, {9, 286}, {10, 702}, {10, 574}, {11, 1406}, {11, 1151}, {11, 1150}, {12, 2814}, {13, 5631}, {13, 5630}}.

The zero-runs are coded with both tables, and then those codes are selected which result in lower number of total bits. Which table is used is eventually used for a frame is indicated by a single bit. The HufLowCoefTable corresponds to the HufLowCoefTable presented above for the first Huffman coding scheme HUF1 and defines the Huffman codeword length and the associated Huffman codeword for each non-zero amplitude value.

For transmission, the bitstream resulting with this coding scheme is organized such that it can be decoded based on the following syntax:

```
HUF3_Decode(int16 *S_dec)
{
int16 qOffset, nonZeroCount, hTbl;
```

-continued

```
nonZeroCount = BsGetBits(4);
hTbl = BsGetBits(1);
for(i=M, qOffset = −1; i < nonZeroCount; i++)
    {
  int16 qCoef;
  int16 run= HufDecodeSymbol ((hTbl == 1) ?
hufLowTable2 : hufLowTable3);
  qOffset += run + 1;
  qCoef = HufDecodeSymbol (hufLowCoefTable);
  qCoef = (qCoef > 2) ? qCoef − 2 : qCoef − 3;
  S_dec[qOffset] = qCoef;
    }
}
```

Also in this syntax, BsGetBits(n) reads n bits from the bitstream buffer. nonZeroCount indicates the number of non-zero value of the quantized spectral side signal samples and hTbl indicates which Huffman table was selected for coding the zero-runs. HufDecodeSymbol( ) decodes the next Huffman codeword from the bitstream, taking into account the respectively employed Huffman table, and returns the symbol that corresponds to this codeword. S_dec[i] is a respective decoded quantized spectral sample value.

Now, the actual Huffman coding loop can be entered.

In a first step, the number G_bits of bits required with all coding schemes HUF1, HUF2, HUF3 are determined. These bits comprise the bits for the quantizer gain qGain and other side information bits. The other side information bits include a flag bit indicating whether the quantized spectral side signal comprises only zero-values and the encoded spatial strength flags provided by the flag generation portion 327.

In a next step, the total number of bits required with each of the three Huffman coding schemes HUF1, HUF2 and HUF3 is determined. This total number of bits comprises the determined number of bits G_bits, the determined number of bits out_bits required for the respective Huffman coding itself, and the number of additional signaling bits required for indicating the employed Huffman coding scheme. A '1' bit pattern is used for the HUF3 scheme, a '01' bit pattern is used for the HUF2 scheme and a '00' bit pattern is used for the HUF1 scheme.

Now, the Huffman coding scheme is determined which requires for the current frame the minimum total number of bits. This Huffman coding schemes is selected for use, in case the total number of bits does not exceed an allowed number of bits. Otherwise, the quantized spectrum is modified.

The quantized spectrum is modified more specifically such that the least significant quantized spectral sample value is set to zero as follows:

$$\hat{S}(\text{least}Idx)=0, \tag{12}$$

where leastIdx is the index of the spectral sample having the smallest energy. This index is retrieved from the array of sorted energies $E_S$ obtained from the sorting portion 326, as mentioned above. Once the sample has been set to zero, the entry for this index is removed from the sorted energy array $E_S$ so that always the smallest spectral sample among the remaining spectral samples can be removed.

All calculations required for the Huffman loop, including the calculations according to equations (9) to (11), are then repeated based on the modified spectrum, until the total number of bits does not exceed the allowed number of bits anymore at least for one of the Huffman coding schemes.

In the presented embodiment, the elements for the low frequency data bitstream are organized for transmission such that it can be decoded based on the following syntax:

```
Low_StereoData(S_dec, M, N, hPanning, qGain)
{
samplesPresent = BsGetBits(1);
if(samplesPresent)
  {
  hPanning = BsGetBits(1);
  if(hPanning == 1) hPanning = (BsGetBits(1)
== 0) ? 2 : 1;
  qGain = BsGetBits(6) + 22;
  if(BsGetBits(1)
    Huf3_Decode(S_dec);
  else if(BsGetBits(1)
    Huf2_Decode(S_dec);
  else
    Huf1_Decode(S_dec);
      }
  }
}
```

As can be seen, the bitstream comprises one bit as indication samplesPresent whether any samples are present in the bitstream, one or two bits for the spatial strength flag hPanning, six bits for the employed quantizing gain qGain, one or two bits for indicating which one of the Huffman coding schemes was used, and the bits required for the employed Huffman coding schemes. The functions Huf1Decode( ), Huf2Decode( ) and Huf3Decode( ) have been defined above for the HUF1, the HUF2 and the HUF3 coding scheme, respectively.

This low frequency data bitstream is provided by the low frequency effect stereo encoder 207 to the AMR-WB+ bitstream multiplexer 205.

The AMR-WB+ bitstream multiplexer 205 multiplexes the side information bitstream received from the stereo extension encoder 206 and the bitstream received from the low frequency effect stereo encoder 207 with the mono signal bitstream for transmission, as described above with reference to FIG. 2.

The transmitted bitstream is received by the stereo decoder 21 of FIG. 2 and distributed by the AMR-WB+ bitstream demultiplexer 215 to the AMR-WB+ mono decoder component 214, the stereo extension decoder 216 and the low frequency effect stereo decoder 217. The AMR-WB+ mono decoder component 214 and the stereo extension decoder 216 process the received parts of the bitstream as decribed above with reference to FIG. 2.

Figure 4:
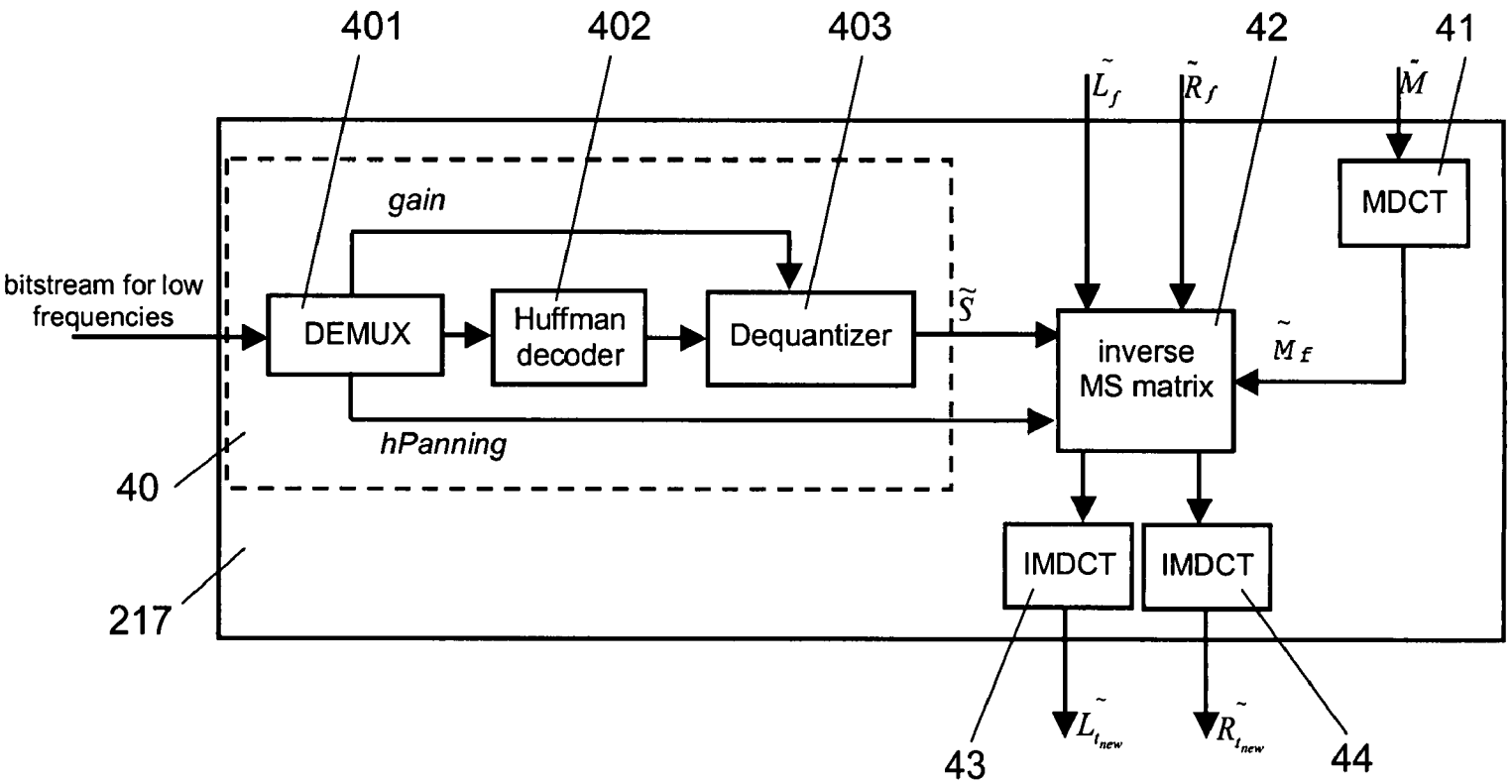
FIG. 4 is a block diagram illustrating a low frequency effect stereo decoder of the stereo audio coding system of FIG. 2.

FIG. 4 is a schematic block diagram of the low frequency effect stereo decoder 217.

The low frequency effect stereo decoder 217 comprises a core low frequency effect decoder 40, an MDCT portion 41, an inverse MS matrix 42, a first IMDCT portion 43 and a second IMDCT portion 44. The core low frequency effect decoder 40 comprises a demultiplexer DEMUX 401, and an output of the AMR-WB+ bitstream demultiplexer 215 of the stereo decoder 21 is connected to this demultiplexer 401. Within the core low frequency effect decoder 40, the demultiplexer 401 is connected via a Huffman decoder portion 402 to a dequantizer 403 and also directly to the dequantizer 403. The demultiplexer 401 is connected in addition to the inverse MS matrix 42. The dequantizer 403 is equally connected to the inverse MS matrix 42. Two outputs of the stereo extension decoder 216 of the stereo decoder 21 are connected as well to the inverse MS matrix 42. The output of the AMR-WB+ mono decoder component 214 of the stereo decoder 21 is connected via the MDCT portion 41 to the inverse MS matrix 42.

The low frequency data bitstream generated by the low frequency effect stereo encoder 207 is provided by the AMR- WB+ bitstream demultiplexer 215 to the demultiplexer 401. The bitstream is parsed by the demultiplexer 401 according to the above presented syntax. The demultiplexer 401 provides the retrieved Huffman codes to the Huffman decoder portion 402, the retrieved quantizer gain to the dequantizer 403 and the retrieved spatial strength flags hPanning to the inverse MS matrix 42.

The Huffman decoder portion 402 decodes the received Huffman codes based on the appropriate one(s) of the above defined Huffman tables hufLowCoefTable[6] [2], hufLowCoefTable_12[7] [2], hufLowTable2[25] [2], hufLowTable3 [25] [3] and hufLowCoefTable, resulting in the quantized spectral side signal $\hat{S}$. The obtained quantized spectral side signal $\hat{S}$ is provided by the Huffman decoder portion 402 to the dequantizer 403.

The dequantizer 403 dequantizes the quantized spectral side signal $\hat{S}$ according to the following equation:

$$\tilde{S}(i) = \mathrm{sign}(\hat{S}(i)) \cdot \hat{S}(i)^{1.33} \cdot 2^{-0.25(gain-0.75)},\ M \le i < N \tag{13}$$

$$\mathrm{sign}(x) = \begin{cases} -1, & \text{if } x \le 0 \\ 1, & \text{otherwise} \end{cases}$$

where the variable gain is the decoded quantizer gain value received from the demultiplexer 401. The obtained dequantized spectral side signal $\tilde{S}$ is provided by the dequantizer 403 to the inverse MS matrix 42.

At the same time, the AMR-WB+ mono decoder component 214 provides a decoded mono audio signal $\tilde{M}$ to the MDCT portion 41. The decoded mono audio signal $\tilde{M}$ is transformed by the MDCT portion 41 into the frequency domain by means of a frame based MDCT, and the resulting spectral mono audio signal $\tilde{M}_f$ is provided to the inverse MS matrix 42.

Further, the stereo extension decoder 216 provides a reconstructed spectral left channel signal $\tilde{L}_f$ and a reconstructed spectral right channel signal $\tilde{R}_f$ to the inverse MS matrix 42.

In the inverse MS matrix 42, first the received spatial strength flags hPanning are evaluated. In case the decoded spatial strength flag hPanning has a value of '1', indicating that the left channel signal was found to be spatially stronger than the right channel signal, or a value of '2', indicating that the right channel signal was found to be spatially stronger than the left channel signal, an attenuation gain gLow for the weaker channel signal is calculated according to the following equation:

$$gLow = \frac{1.0}{g^{1/8}} \tag{14}$$

$$g = \frac{\sum_{i=M}^{N-1} \tilde{M}_f(i) \cdot \tilde{M}_f(i)}{N - M}$$

Then, the low frequency spatial left $L_f$ and right $R_f$ channel samples are reconstructed as follows:

$$L_f(i) = \begin{cases} gLow \cdot LR_L, & \text{if } hPanning = 2 \\ LR_L, & \text{otherwise} \end{cases},\ M \le i < N \tag{15}$$

-continued $$R_f(i) = \begin{cases} gLow \cdot LR_R, & \text{if } hPanning = 1 \\ LR_R, & \text{otherwise} \end{cases},\ M \le i < N$$

$$LR_L = \tilde{M}_f(i) + \tilde{S}(i - M) \quad LR_R = M_f(i) - \tilde{S}(i - M)$$

To the obtained low frequency spatial left $L_f$ and right $R_f$ channel samples, the spatial left $\tilde{L}_f$ and right $\tilde{R}_f$ channel samples received from the stereo extension decoder 216 are added from spectral sample index N−M onwards.

Finally, the combined spectral left channel signal is transformed by the IMDCT portion 43 into the time domain by means of a frame based IMDCT, in order to obtain the restored left channel signal $\tilde{L}_{new}$, which is then output by the stereo decoder 21. The combined spectral right channel signal is transformed by the IMDCT portion 44 into the time domain by means of a frame based IMDCT, in order to obtain the restored right channel signal $\tilde{R}_{new}$, which is equally output by the stereo decoder 21.

The presented low frequency extension method efficiently encodes the important low frequencies with a low bitrate and integrates smoothly with the employed general stereo audio extension method. It performs best at low frequencies below 1000 Hz, where the spatial hearing is critical and sensitive.

Obviously, the described embodiment can be varied in many ways. One possible variation concerning the quantization of the side signal S generated by the side signal generating portion 321 will be presented in the following.

In the above described approach, the spectral samples are quantized such that the maximum absolute value of the quantized spectral samples is below the threshold value T, and this threshold value was set to fixed value T=3. In a variation of this approach, the threshold value T can take one of two values, e.g. a value of either T=3 or T=4.

It is an aim of the presented variation to make a particularly efficient use of the available bits.

Using a fixed threshold value T for encoding the spectral side signal S can lead to a situation in which the number of used bits, after the encoding operation, is much smaller that the number of the available bits. From the stereo perception point of view, it is desirable that all available bits are used as efficiently as possible for coding purposes and thus that the number of unused bits is minimized. When operating under fixed bitrate conditions, the unused bits would have to be sent as stuffing and/or padding bits, which would make to overall coding system inefficient.

The whole encoding operation in the varied embodiment of the invention is carried out in a two stage encoding loop.

In a first stage, the spectral side signal is quantized and Huffman encoded using a first, lower threshold value T, i.e. in the current example a threshold value T=3. The processing in this first stage corresponds exactly to the above described encoding by the quantization loop portion 322, the selection portion 323 and the Huffman loop portion 324 of the low frequency stereo encoder 207.

The second stage is entered only when the encoding operation of the first stage indicates that it might be beneficial to increase the threshold value T in order to obtain a finer spectral resolution. After the Huffman encoding, it is therefore determined whether the threshold value is T=3 and the number of unused bits is higher than 14 and no spectral dropping was performed by setting the least significant spectral sample to zero. If all these conditions are met, the encoder knows that in order to minimize the number of unused bits, the threshold value T has to be increased. In the current example the threshold value T is thus increased by one to T=4. Only in this case, the second stage of the encoding is entered. In the second stage, the spectral side signal is first re-quantized by the quantization loop portion 322 as described above, except that this time, the quantizer gain value is calculated and adjusted so that the maximum absolute value of the quantized spectral side signal lies below a value of 4. After a processing in the selection portion 323 as described above, the above described Huffman loop is entered again. As the Huffman amplitude tables HufLowCoefTable and HufLowCoefTable_12 have already been designed for amplitude values lying between −3 and 3, no modifications are needed to the actual encoding steps. The same applies also for the decoder part.

Then, the encoding loop is exited.

Thus, if the second stage is selected during the encoding, the output bitstream is generated with a threshold value of T=4, and otherwise the output bitstream is generated with threshold value of T=3.

It is to be noted that the described embodiment constitutes only one of a variety of possible embodiments of the invention.

The invention claimed is:

1. Method for supporting a multichannel audio extension at an encoding end of a multichannel audio coding system, said method comprising:

generating and providing first multichannel extension information at least for higher frequencies of a multichannel audio signal, which first multichannel extension information allows to reconstruct at least said higher frequencies of said multichannel audio signal based on a mono audio signal available for said multichannel audio signal;

generating and providing second multichannel extension information for lower frequencies of said multichannel audio signal, which second multichannel extension information allows to reconstruct said lower frequencies of said multichannel audio signal based on said mono audio signal with a higher accuracy than said first multichannel extension information allows to reconstruct at least said higher frequencies of said multichannel audio signal; and generating and providing in addition an indication for additional use in a reconstruction of the lower frequencies of the multichannel audio signal, said indication comprising a first bit indicating whether any channel of said multichannel audio signal is considerably stronger at said lower frequencies of said multichannel audio signal than another channel of said multichannel audio signal, and said indication comprising at least in the case that a channel of said multichannel audio signal is considerably stronger at said lower frequencies of said multichannel audio signal than another channel of said multichannel audio signal a second bit indicating which channel of said multichannel audio signal is considerably stronger than another channel of said multichannel audio signal.

2. Method according to claim 1, wherein generating and providing said second multichannel extension information comprises transforming a first channel signal of a multichannel audio signal into the frequency domain, resulting in a spectral first channel signal;

transforming a second channel signal of said multichannel audio signal into the frequency domain, resulting in a spectral second channel signal;

generating a spectral side signal representing the difference between said spectral first channel signal and said spectral second channel signal;

quantizing said spectral side signal to obtain a quantized spectral side signal;

encoding said quantized spectral side signal and providing said encoded quantized spectral side signal as part of said second multichannel extension information.

3. Method according to claim 2, wherein said quantizing comprises quantizing said spectral side signal in a loop in which the quantizing gain is varied such that a quantized spectral side signal is obtained of which the maximum absolute value lies below a predetermined threshold value.

4. Method according to claim 3, wherein said predetermined threshold value is adjusted to ensure that said encoding of said quantized spectral side signal results in a number of bits which lies less than a predetermined number of bits below a number of available bits.

5. Method according to claim 3, further comprising setting all values of said quantized spectral side signal to zero, in case a quantizing gain required for said obtained quantized spectral side signal lies below a second predetermined threshold value.

6. Method according to claim 2, further comprising setting all values of said quantized spectral side signal to zero, in case an average energy at said lower frequencies of said spectral first and second channel signals lies below a predetermined threshold value.

7. Method according to claim 2, further comprising setting those values of said quantized spectral side signal to zero, which do not belong to a spectral environment providing a significant contribution to a multichannel image in said multichannel audio signal.

8. Method according to claim 2, wherein said encoding is based on a Huffman coding scheme.

9. Method according to claim 2, wherein said encoding comprises selecting one of at least two coding schemes, which selected coding scheme results for said quantized spectral side signal in the least number of bits.

10. Method according to claim 2, wherein said encoding comprises discarding at least the sample of said quantized spectral side signal having the lowest energy, in case encoding said entire quantized spectral side signal results in a number of bits exceeding a number of available bits.

11. Method according to claim 1, wherein said indication is generated for a respective frame of said multichannel audio signal based on samples of said frame and samples of at least one of a previous frame and a next frame of said multichannel audio signal.

12. Method for supporting a multichannel audio extension at a decoding end of a multichannel audio coding system, said method comprising:

reconstructing at least higher frequencies of a multichannel audio signal based on received first multichannel extension information for said multichannel audio signal and on a received mono audio signal for said multichannel audio signal; and reconstructing lower frequencies of said multichannel audio signal based on received second multichannel extension information, on an indication comprising a first bit indicating whether any channel of said multichannel audio signal is considerably stronger at said lower frequencies of said multichannel audio signal than another channel of said multichannel audio signal and comprising at least in the case that a channel of said multichannel audio signal is considerably stronger at said lower frequencies of said multichannel audio signal than another channel of said multichannel audio signal a second bit indicating which channel of said multichannel audio signal is considerably stronger than another channel of said multichannel audio signal, and on said received mono audio signal with a higher accuracy than said higher frequencies; and combining said reconstructed higher frequencies and said reconstructed lower frequencies to a reconstructed multichannel audio signal.

13. Method according to claim 12, wherein reconstructing lower frequencies of said multichannel audio signal comprises decoding a quantized spectral side signal comprised in said second multichannel extension information;

dequantizing said quantized spectral side signal to obtain a dequantized spectral side signal; and extending said received mono audio signal with said dequantized spectral side signal to obtain reconstructed lower frequencies of a spectral first channel signal and of a spectral second channel signal of said multichannel audio signal.

14. Method according to claim 13, further comprising attenuating one of said spectral channel signals at said lower frequencies, in case said second multichannel extension information further comprises an indication that another one of said spectral channel signals was considerably stronger in said multichannel audio signal which is to be reconstructed at said lower frequencies.

15. An apparatus comprising:

an information generation component configured to generate and provide first multichannel extension information at least for higher frequencies of a multichannel audio signal, which first multichannel extension information allows to reconstruct at least said higher frequencies of said multichannel audio signal based on a mono audio signal available for said multichannel audio signal;

an information generation component configured to generate and provide second multichannel extension information for lower frequencies of said multichannel audio signal, which second multichannel extension information allows to reconstruct said lower frequencies of said multichannel audio signal based on said mono audio signal with a higher accuracy than said first multichannel extension information allows to reconstruct at least said higher frequencies of said multichannel audio signal; and an information generation component configured to generate and provide in addition an indication for additional use in a reconstruction of the lower frequencies of the multichannel audio signal, said indication comprising a first bit indicating whether any channel of said multichannel audio signal is considerably stronger at said lower frequencies of said multichannel audio signal than another channel of said multichannel audio signal, and said indication comprising at least in the case that a channel of said multichannel audio signal is considerably stronger at said lower frequencies of said multichannel audio signal than another channel of said multichannel audio signal a second bit indicating which channel of said multichannel audio signal is considerably stronger than another channel of said multichannel audio signal.

16. The apparatus according to claim 15, wherein said apparatus is one of a multichannel audio encoder, a multichannel extension encoder for a multichannel audio encoder, and a mobile terminal.

17. An apparatus for supporting a multichannel audio extension at a decoding end of a multichannel audio coding system, said apparatus comprising:

a reconstruction component configured to reconstruct at least higher frequencies of a multichannel audio signal based on received first multichannel extension information for said multichannel audio signal and on a received mono audio signal for said multichannel audio signal; and a reconstruction component configured to reconstruct lower frequencies of said multichannel audio signal based on received second multichannel extension information, on an indication comprising a first bit indicating whether any channel of said multichannel audio signal is considerably stronger at said lower frequencies of said multichannel audio signal than another channel of said multichannel audio signal and comprising at least in the case that a channel of said multichannel audio signal is considerably stronger at said lower frequencies of said multichannel audio signal than another channel of said multichannel audio signal a second bit indicating which channel of said multichannel audio signal is considerably stronger than another channel of said multichannel audio signal, and on said received mono audio signal with a higher accuracy than said higher frequencies; and a combining component configured to combine said reconstructed higher frequencies and said reconstructed lower frequencies to a reconstructed multichannel audio signal.

18. The apparatus according to claim 17, wherein said apparatus is one of a multichannel audio decoder, a multichannel extension decoder for a multichannel audio decoder, and a mobile terminal.

19. Multichannel audio coding system comprising an apparatus according to claim 15 and a decoder with:

a reconstruction component configured to reconstruct at least higher frequencies of a multichannel audio signal based on received first multichannel extension information for said multichannel audio signal and on a received mono audio signal for said multichannel audio signal; and a reconstruction component configured to reconstruct lower frequencies of said multichannel audio signal based on received second multichannel extension information and on said received mono audio signal with a higher accuracy than said higher frequencies; and a combining component configured to combine said reconstructed higher frequencies and said reconstructed lower frequencies to a reconstructed multichannel audio signal.

20. Method according to claim 4, further comprising setting all values of said quantized spectral side signal to zero in case a quantizing gain required for said obtained quantized spectral side signal lies below a second predetermined threshold value.

21. A computer readable medium storing program code, said program code realizing the method according to claim 1 when being executed.

22. A computer readable medium storing program code, said program code realizing the method according to claim 12 when being executed.

23. An apparatus for supporting a multichannel audio extension at an encoding end of a multichannel audio coding system, said apparatus comprising:

means for generating and providing first multichannel extension information at least for higher frequencies of a multichannel audio signal, which first multichannel extension information allows to reconstruct at least said higher frequencies of said multichannel audio signal based on a mono audio signal available for said multichannel audio signal;

means for generating and providing second multichannel extension information for lower frequencies of said multichannel audio signal, which second multichannel extension information allows to reconstruct said lower frequencies of said multichannel audio signal based on said mono audio signal with a higher accuracy than said first multichannel extension information allows to reconstruct at least said higher frequencies of said multichannel audio signal; and means for generating and providing in addition an indication for additional use in a reconstruction of the lower frequencies of the multichannel audio signal, said indication comprising a first bit indicating whether any channel of said multichannel audio signal is considerably stronger at said lower frequencies of said multichannel audio signal than another channel of said multichannel audio signal, and said indication comprising at least in the case that a channel of said multichannel audio signal is considerably stronger at said lower frequencies of said multichannel audio signal than another channel of said multichannel audio signal a second bit indicating which channel of said multichannel audio signal is considerably stronger than another channel of said multichannel audio signal.

24. An apparatus comprising:

means for reconstructing at least higher frequencies of a multichannel audio signal based on received first multichannel extension information for said multichannel audio signal and on a received mono audio signal for said multichannel audio signal; and means for reconstructing lower frequencies of said multichannel audio signal based on received second multichannel extension information, on an indication comprising a first bit indicating whether any channel of said multichannel audio signal is considerably stronger at said lower frequencies of said multichannel audio signal than another channel of said multichannel audio signal and comprising at least in the case that a channel of said multichannel audio signal is considerably stronger at said lower frequencies of said multichannel audio signal than another channel of said multichannel audio signal a second bit indicating which channel of said multichannel audio signal is considerably stronger than another channel of said multichannel audio signal, and on said received mono audio signal with a higher accuracy than said higher frequencies; and means for combining said reconstructed higher frequencies and said reconstructed lower frequencies to a reconstructed multichannel audio signal.

25. The apparatus according to claim 15, wherein for generating and providing said second multichannel extension information said information generation component configured to generate and provide second multichannel extension information is configured to:

transform a first channel signal of a multichannel audio signal into the frequency domain, resulting in a spectral first channel signal;

transform a second channel signal of said multichannel audio signal into the frequency domain, resulting in a spectral second channel signal;

generate a spectral side signal representing the difference between said spectral first channel signal and said spectral second channel signal;

quantize said spectral side signal to obtain a quantized spectral side signal;

encode said quantized spectral side signal and providing said encoded quantized spectral side signal as part of said second multichannel extension information.

26. The apparatus according to claim 25, wherein said quantizing comprises quantizing said spectral side signal in a loop in which the quantizing gain is varied such that a quantized spectral side signal is obtained of which the maximum absolute value lies below a predetermined threshold value.

27. The apparatus according to claim 25, wherein said information generation component configured to generate and provide second multichannel extension information is further configured to set all values of said quantized spectral side signal to zero, in case an average energy at said lower frequencies of said spectral first and second channel signals lies below a predetermined threshold value.

28. The apparatus according to claim 25, wherein said information generation component configured to generate and provide second multichannel extension information is further configured to set those values of said quantized spectral side signal to zero, which do not belong to a spectral environment providing a significant contribution to a multichannel image in said multichannel audio signal.

29. The apparatus according to claim 25, wherein said encoding comprises a selection of one of at least two coding schemes, which selected coding scheme results for said quantized spectral side signal in the least number of bits.

30. The apparatus according to claim 17, wherein for reconstructing lower frequencies of said multichannel audio signal, said reconstruction component configured to reconstruct lower frequencies of said multichannel audio signal is configured to decode a quantized spectral side signal comprised in said second multichannel extension information;

dequantize said quantized spectral side signal to obtain a dequantized spectral side signal; and extend said received mono audio signal with said dequantized spectral side signal to obtain reconstructed lower frequencies of a spectral first channel signal and of a spectral second channel signal of said multichannel audio signal.

31. The apparatus according to claim 30, wherein for reconstructing lower frequencies of said multichannel audio signal, said reconstruction component configured to reconstruct lower frequencies of said multichannel audio signal is configured to attenuate one of said spectral channel signals at said lower frequencies, in case said second multichannel extension information further comprises an indication that another one of said spectral channel signals was considerably stronger in said multichannel audio signal which is to be reconstructed at said lower frequencies.

* * * * *

UNITED STATES PATENT AND TRADEMARK OFFICE

CERTIFICATE OF CORRECTION

PATENT NO. : 7,627,480 B2
APPLICATION NO. : 10/834376
DATED : December 1, 2009
INVENTOR(S) : Juha Ojanpera It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1358 days.

Signed and Sealed this

Twenty-first Day of December, 2010

David J. Kappos

David J. Kappos
*Director of the United States Patent and Trademark Office*